US008027634B1

(12) United States Patent
Warner et al.

(10) Patent No.: US 8,027,634 B1
(45) Date of Patent: Sep. 27, 2011

(54) RFID SYSTEM FOR SUBSCRIPTION SERVICES WITH MULTIPLE SUBSCRIBERS AND/OR DEVICES

(75) Inventors: Janice Warner, Holmdel, NJ (US); Robert Warner, Holmdel, NJ (US); Jack Winters, Middletown, NJ (US)

(73) Assignee: Eigent Technologies Inc., Holmdel, NJ (US)

( * ) Notice: Subject to any disclaimer, the term of this patent is extended or adjusted under 35 U.S.C. 154(b) by 1168 days.

(21) Appl. No.: 11/803,906

(22) Filed: May 16, 2007

Related U.S. Application Data

(60) Provisional application No. 60/800,650, filed on May 16, 2006.

(51) Int. Cl.
*H04H 20/71* (2008.01)
*H04H 60/09* (2008.01)

(52) U.S. Cl. ..... 455/3.03; 455/3.01; 455/3.02; 455/3.05; 455/3.06; 455/409; 455/41.1; 455/41.2; 455/556.1; 340/539.1; 340/539.11; 340/568.1; 340/572.1; 340/13.26

(58) Field of Classification Search ..... 455/3.01–3.06, 455/41.1–41.2, 418–420, 409, 556.1; 340/539.1, 340/539.11, 539.16, 539.17, 572.1, 572.4, 340/568.1, 568.5, 568.8, 13.24, 13.26
See application file for complete search history.

(56) References Cited

U.S. PATENT DOCUMENTS

| | | | | |
|---|---|---|---|---|
| 6,549,774 | B1 | 4/2003 | Titlebaum et al. | |
| 7,123,875 | B1 | 10/2006 | Marko et al. | |
| 7,126,481 | B2 * | 10/2006 | Vesikivi et al. | 340/572.4 |
| 7,433,649 | B2 * | 10/2008 | Toulis et al. | 455/41.2 |
| 7,756,467 | B2 * | 7/2010 | Bent et al. | 455/3.04 |
| 2003/0120745 | A1 * | 6/2003 | Katagishi et al. | 709/217 |
| 2006/0258289 | A1 * | 11/2006 | Dua | 455/41.3 |

OTHER PUBLICATIONS

U.S. Appl. No. 11/153,074, filed Jun. 15, 2005, Robert Warner.
U.S. Appl. No. 11/359,268, filed Feb. 22, 2006, Robert Warner.

* cited by examiner

*Primary Examiner* — Tuan A Tran
(74) *Attorney, Agent, or Firm* — Porzio, Bromberg & Newman, P.C.

(57) ABSTRACT

The RFID system of the present invention provides activation of a subscription based device wirelessly using a RFID system. The system for activating of a user for a subscription service comprises a first secure RFID sensor associated with a subscription-based device and a second secure RFID sensor associated with a user device. The first and second secure RFID sensors communicate with one another to establish activation of the user device. For example, the first sensor can receive an authentication value associated with the subscription service from the second RFID sensor. After activation, the subscription-based device can broadcast the subscription service to the user device. Alternatively, the user device can also have a capability to verify its separate or related subscription such as WiFi, WiMAX, GSM, CDMA or other wireless-based connectivity service. Also, the user device associated with the subscription-based service can be activated only when a secure RFID sensor is within a predetermined range of the user device.

23 Claims, 4 Drawing Sheets

RFID SYSTEM FOR SUBSCRIPTION SERVICES WITH MULTIPLE SUBSCRIBERS AND/OR DEVICES

CROSS REFERENCE TO RELATED APPLICATION

This application claims the benefit of U.S. Provisional Patent Application No. 60/800,650, filed May 16, 2006, the entirety of which is hereby incorporated by reference into this application.

BACKGROUND OF THE INVENTION

Systems for distributing and receiving satellite broadcasts are known. U.S. Pat. No. 7,123,875 describes a system for multipoint distribution of satellite digital audio radio service in which a satellite digital audio radio service is distributed to a plurality of receivers that are not independently mobile relative to each other. The receivers may be located in automobiles, hand held or standing units for home or office use. Each receiver includes a channel decoder and a secure decoder to allow for channel selection and audio processing.

U.S. Pat. No. 6,549,774 describes a digital audio service satellite receiver having switchable operating modes for stationary or mobile use. The receiver is configured to detect the mode in which it is operating. In stationary mode, the receiver unit is configured for pointing the antenna to the satellite which provides the best line of sight reception of the satellite signal. In mobile operating mode, the receiver is operable to dynamically select one of the satellite signals for output or to combine two satellite signals.

Subscription service devices, such as satellite radio and video devices, receive broadcasts if authorized by paid subscriptions. The paid subscriptions are authorized from a central database. If such a subscription is not paid, then the device is disabled from receiving such services. It is desirable for a user with a subscription to be able to activate a variety of devices, such as a home stereo or car radio, with only one device active per subscription at a given point in time. One conventional method to do this is the XM Passport. The XM Passport is a small tuner that can deliver XM satellite radio capability to a variety of devices when these devices are equipped with a docking station or port for the XM Passport to be inserted into. However, this device is relatively expensive, as it contains an XM satellite tuner, it is too large to be convenient and it requires physically plugging the device into a compatible player.

It is desirable to provide a RFID system for subscription services for use with a plurality of subscribers and/or devices.

SUMMARY OF THE INVENTION

The RFID system of the present invention provides activation of a subscription based device wirelessly using a RFID sensor. The RFID sensor can be lightweight and compact. The RFID sensor of the present invention does not require a tuner—the tuner can be in the compatible player thus significantly lowering the cost of the activation device. Accordingly, a subscriber only has to be in the vicinity of a compatible player, and does not have to pull out the conventional activation device and physically plug it into the compatible player. Thus, the present invention provides greater ease of use and better overall convenience.

In one embodiment, the RFID system of the present invention can be made secure using lightweight security methods, such as, for example, conventional SHA-1 or SHA-x hashing on concatenations of tag id and random number to guard against unauthorized use of the compatible player through replay of eavesdropped transmissions from subscribers. For dedicated usage such as for a predetermined satellite radio service, the security algorithm can be managed by a service provider. Alternatively, for cross-platform or service usage, the security algorithm can be managed as a service by an independent third party.

The system for activation of a user for a subscription service comprises a first secure RFID sensor associated with a subscription-based device and a second secure RFID sensor associated with a user device. The first and second secure RFID sensors communicate with one another to establish activation of the user device. For example, the first sensor can receive an authentication value associated with the subscription service from the second RFID sensor. After activation, the subscription-based device can broadcast the subscription service to the user device. Alternatively, the user device can also have means to verify its separate or related subscription such as WiFi, WiMAX, GSM, CDMA or other wireless-based connectivity service.

The use of a RFID system to activate a subscription-based device provides an opportunity to have multiple subscriber devices. For example, for commuters on a plane, train, car or bus, and people in a large room or public area, and the like, multiple subscribers can use headphones, each one of which has a RFID for activation and a connection to one multiple subscriber device. The headphones receive a broadcast stream from the multiple subscriber devices if the headphones contain a RFID sensor with the authorization. Alternatively, the headphones receive a broadcast stream from a multiple subscriber device if the headphones were located in a predetermined vicinity of a RFID sensor with the authorization, for example, an authorized RFID user. Accordingly, the headphones, for example, can be relatively inexpensive, with the majority of the electronics, including the tuners, multiplexed among the authorized users in the multiple subscriber device. The service provider can provide multiple subscriptions for a given device and thereby enhance its profitability.

Another use of a RFID system to activate a subscription-based device is authorization of the subscriber to a subscription-based device for only a short period of time. For example, a satellite radio subscriber can be authorized to use the satellite receiver in a rental car only when the subscriber was renting the car (perhaps for an additional fee). In this case, the satellite receiver in the car would only be activated when a subscriber with a RFID sensor having authorization left the rental lot and passed by a RFID reader at the exit to the lot. Thus, both the subscriber RFID activation and the RFID activation of leaving the lot (with deactivation when returning to the lot) are needed to enable the subscription based device in the rental car. Other examples of this application include short-term promotions by the service provider that is trying to entice a potential subscriber to sign on to, time-based subscriptions such as weekend-only or commuter-only subscriptions that might appeal to more cost conscious subscribers, and special event-tailored content and premium content offerings that might be tied to a user device with a separate or related subscription with subscription verification through WiFi, WiMAX, GSM, CDMA or other wireless-based connectivity service.

The invention will be more fully described by reference to the following drawings.

DETAILED DESCRIPTION

Figure 1:
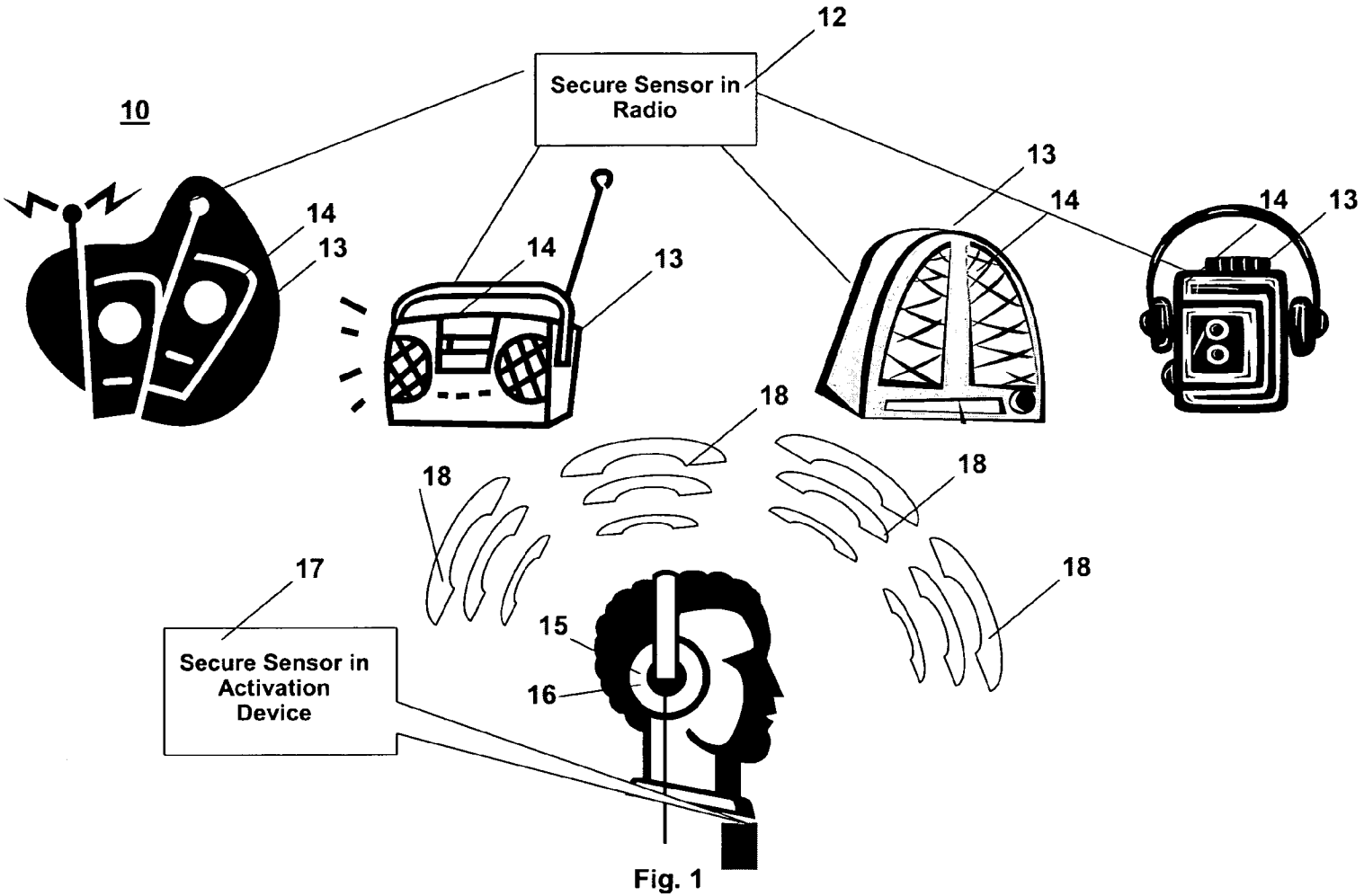
FIG. 1 is a schematic diagram of a RFID system for activation of subscription services including multiple subscription-based devices.

Reference will now be made in greater detail to a preferred embodiment of the invention, an example of which is illustrated in the accompanying drawings. Wherever possible, the same reference numerals will be used throughout the drawings and the description to refer to the same or like parts.

The present invention relates to a RFID system which is used to activate a subscription-based device.

Figure 2:
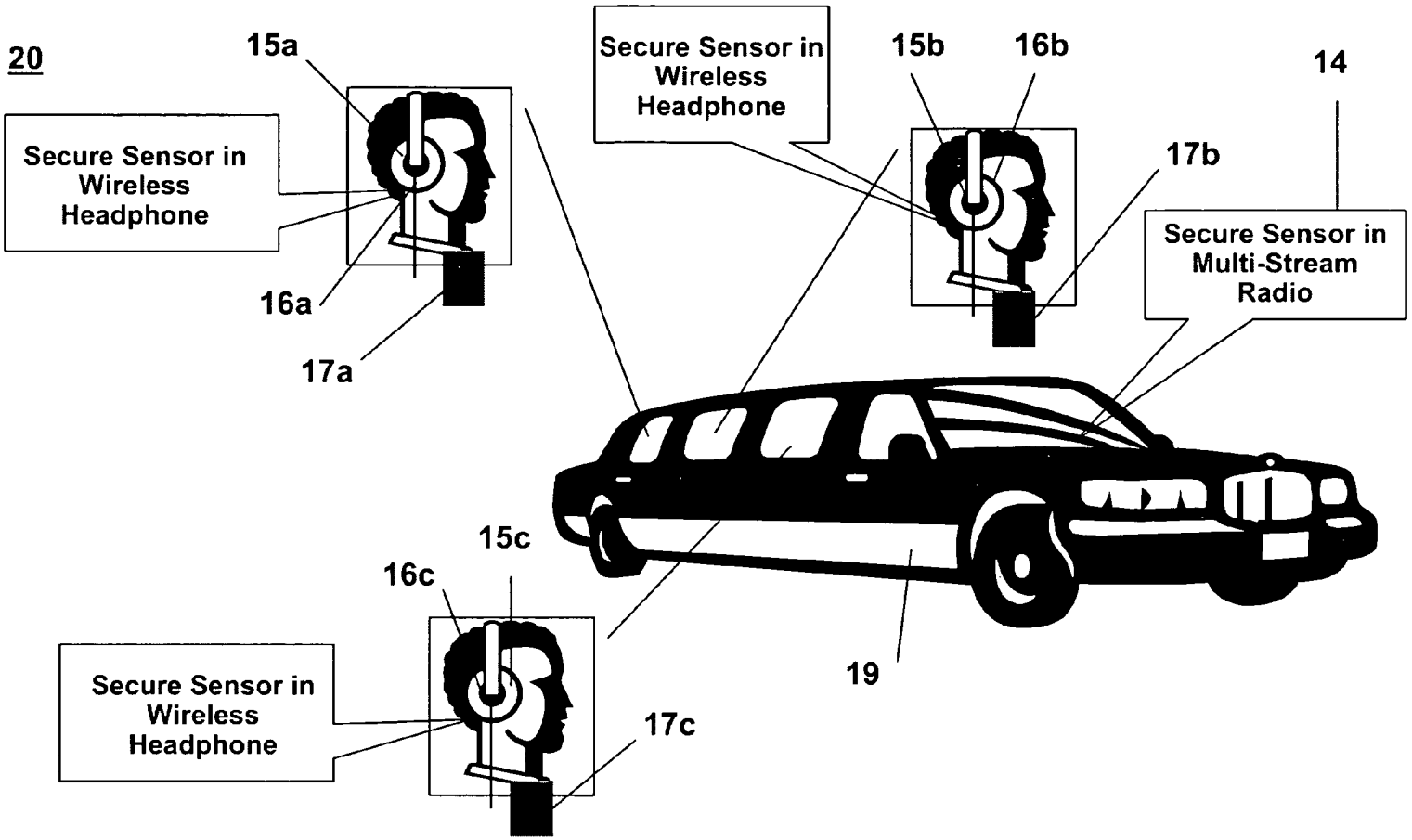
FIG. 2 is a schematic diagram of a RFID system for activation of subscription services including multiple subscribers.

FIGS. 1 and 2 are schematic diagrams of RFID system 10 for activation of a subscription-based service. RFID system 10 can be used for activating subscription services for one or more subscription-based devices and/or for activating one or more subscribers to use one or more of the subscription-based devices. Secure RFID sensor 12 is associated with subscription-based device 14. For example, subscription-based device 14 can be one or more types of satellite radio receivers, as shown in FIG. 1. In one embodiment, secure RFID sensor 12 is positioned within housing 13 of subscription-based device 14.

Secure RFID sensor 15 is associated with user device 16. Secure RFID sensor 15 can include an authorization for use of subscription-based device 14. For example, user device 16 can be headphones and secure RFID sensor 15 can be associated with the headphones.

Secure RFID sensor 17 can also be associated with user device 16. Secure RFID sensor 17 can include an authorization for use of subscription-based device 14. Secure RFID sensor 17 can be associated with the user. For example, secure RFID sensor 17 can be an electronic card or key which is located on or in a predetermined vicinity of a user with subscription verification by association with the receiver or through WiFi, WiMAX, GSM, CDMA or other wireless-based connectivity service. Secure RFID sensor 15 and/or secure RFID sensor 17 can communicate the authorization in a secure challenge response protocol to secure RFID sensor 12 for activation of subscription-based device 14. User device 16 only receives broadcast stream 18 from subscription-based device 14 if user device 16 includes secure RFID sensor 15 with the authorization for use of the subscription-based device and/or secure RFID sensor 17 with the authorization for use of the subscription-based device is within a predetermined proximity of the user.

In one embodiment, a plurality of user devices 16*a*-16*c* include secure RFID sensors 15*a*-15*c*, as shown in FIG. 2. Alternatively, secure RFID sensors 17*a*-17*c* can be associated with a respective user 16*a*-16*c*. For example, subscription-based device 14 can include a multi stream radio service receiver located within vehicle 19. Each of user devices 16*a*-16*c* only receives broadcast stream 18 from subscription-based device 14 if user devices 16*a*-16*c* includes secure RFID sensors 15*a*-15*c* with the authorization for use of the subscription-based device and/or secure RFID sensors 17*a*-17*c* with the authorization for use of the subscription-based device is within proximity of the user.

A preferred embodiment for this activation using a RFID system can be implemented as described in U.S. patent application Ser. No. 11/153,074 and U.S. patent application Ser. No. 11/359,268, both of which are hereby incorporated in their entirety by reference into this application. These applications describe methods whereby one or more RFID or wireless sensor devices indicate when they are in proximity to one another (wired or wireless). The technique uses two or more networked devices such that, when the link is broken, host devices can be disabled and the link disconnect can be communicated to the standards-based RFID/sensor reader infrastructure. In this manner the solution is low cost and light weight, and uses a compact sized-device with simple device proximity for authentication and activation.

RFID systems operate by having a signal transmitted by a reader to the RFID sensor. This sensor can be active or passive. With a passive sensor, the received signal is reflected back to the reader using a backscatter technique to modulate the reflected signal, with part of the received signal energy at the sensor used to power the sensor. With an active sensor, a battery supplies the transmitted energy, along with the power for the sensor electronics. The active sensor has a lifetime limited by the battery, while the passive sensor can potentially have an unlimited lifetime, but has much less signal processing capability. A passive sensor could be used as a small device to activate a player, while an active sensor might be used within headphones that would have their own battery. In either case, the sensor responds with a signal to the reader when it is probed. If the correct responses are received by the reader, then the device is activated. Thus, the RFID sensor must be within the appropriate range of the reader, with the predetermined range based on received signal strength at the reader.

Figure 3:
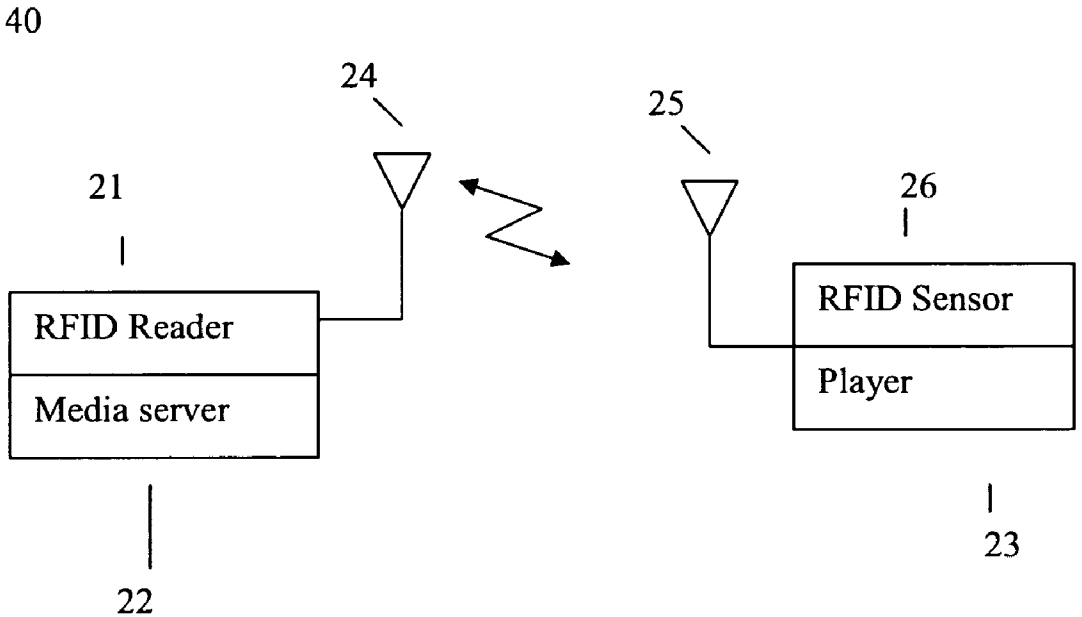
FIG. 3 is a schematic diagram of an embodiment of a RFID system.

In one embodiment, secure RFID sensor 26 is collocated with player 23, as shown in RFID system 40 in FIG. 3. RFID reader 21 is collocated with media server 22. RFID reader 21 sends a probe signal from antenna 24. If secure RFID sensor 26 is within range of RFID reader 21, it receives the signal on antenna 25 and transmits the appropriate response back to RFID reader 21 through antenna 25 to antenna 24. Upon authentication by RFID system 40, media server 22 communicates with player 23 wirelessly through antennas 24 and 25 so that the user can listen to player 23.

Specifically, RFID system 40 can utilize probe-response signals that can be based on a secure challenge-response protocol to ensure that when a response is received, the device receiving the response to its challenge can be assured that the response was generated with authenticated verification of the intended device characteristics. In addition, to prevent surreptitious probing of secure RFID sensor 26 to attempt to learn information about the protected devices, the challenge-response protocol would produce a two-way authentication. The RFID probe-response signals generated can be based on a secure challenge-response protocol so that when a response is received, the device receiving the response to its challenge can be assured that the response was generated with authenticated verification of the intended device characteristics.

Figure 4:
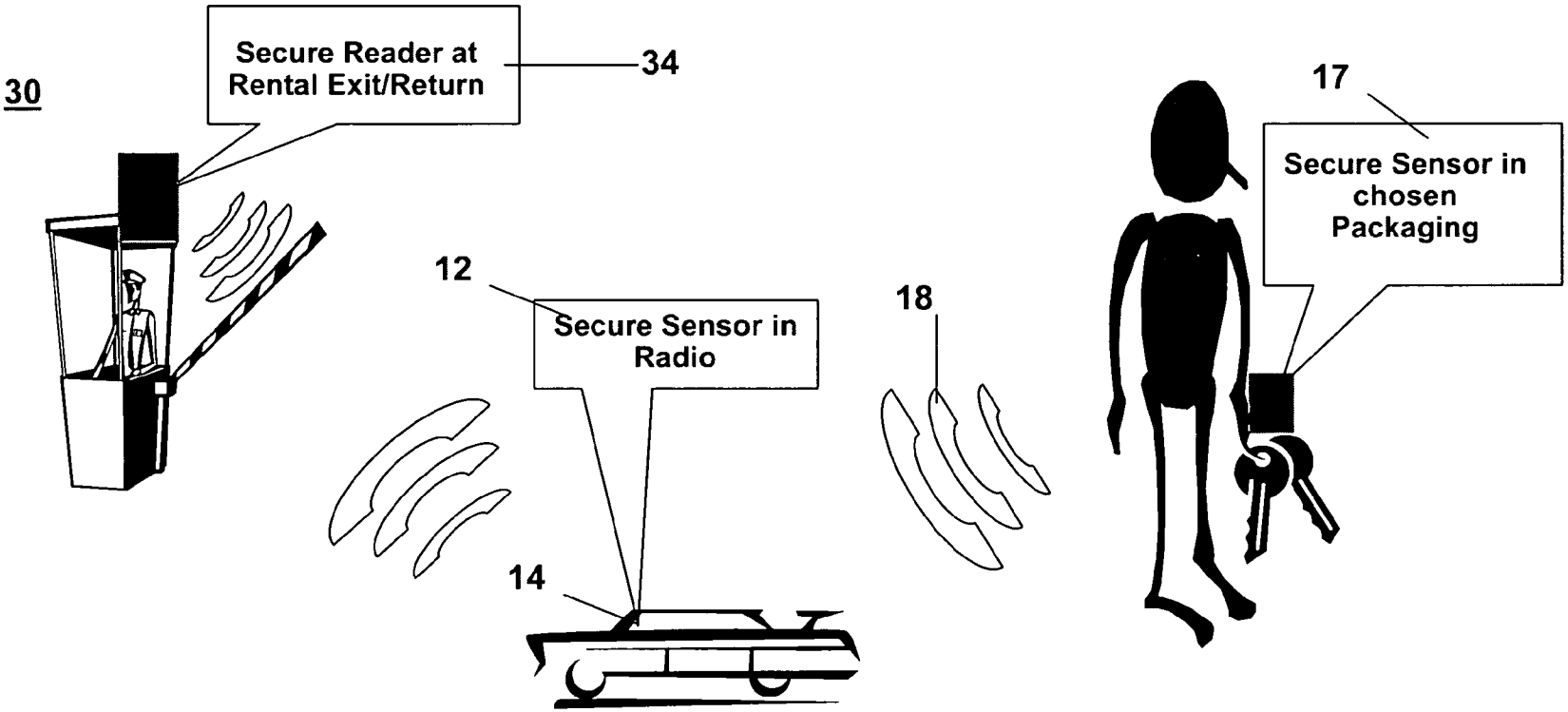
FIG. 4 is a schematic diagram of a RFID system for activation of subscription services for a predetermined period of time.

FIG. 4 illustrates an alternate embodiment RFID system 30. RFID system 30 can be used for activating subscription services for a predetermined period of time. In one embodiment, subscription-based device 14 is a satellite radio. Secure RFID sensor 12 associated with subscription-based device 14 is activated by secure RFID reader 34. For example, secure RFID sensor 12 can be activated by secure RFID reader 34 when entering a predetermined vicinity of secure RFID reader 34. In one embodiment, secure RFID reader 34 can be positioned at an exit or a return for a rental vehicle. Subscription-based device 14 is associated with the rental vehicle. Secure RFID reader 34 can activate secure RFID sensor 12 associated with subscription-based device 14 after the rental vehicle enters the predetermined vicinity of secure RFID reader 34. After activation of secure RFID sensor 12, activation of the user can be provided through communication between secure RFID sensor 15 and/or secure RFID sensor 17 with secure RFID sensor 12, as described above.

RFID system 10 and RFID system 20 can be made secure with a hashing algorithm such as SHA-1 or SHA-x on concatenations of tag id and random number to guard against unauthorized use of the compatible player through replay of eavesdropped transmissions from subscribers. The security algorithm can be managed by a subscription service provider.

In one embodiment, the same RFID system 10 can be used for different subscription services, for example both XM and Sirius satellite radio or for, a rental car company, such as Hertz with Sirius and Hertz with XM. To overcome the issue of which company would control the secure hash, an external entity can be used to control the secure hash for multiple companies.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A system for activation of a user for a subscription service comprising:

a first RFID sensor associated with a subscription-based device, said subscription-based device providing said subscription service;

a second RFID sensor associated with a user device;

means for activating said user device based on communication between said first RFID sensor and said second RFID sensor, wherein said subscription-based device can broadcast said subscription service to said user device after activation of said user device; and a reader, said reader activating or deactivating said first RFID sensor when said first RFID sensor is in a predetermined vicinity of said reader.

2. The system of claim 1 further comprising:

a plurality of said subscription-based devices; and a plurality of first RFID sensors, each of said subscription-based devices being associated with one of said first RFID sensors.

3. The system of claim 1 further comprising:

a plurality of user devices and a plurality of second RFID sensors, each of said user devices being associated with one of said second RFID sensors.

4. The system of claim 1 wherein said subscription based device is a satellite radio receiver.

5. The system of claim 1 wherein said user device is headphones.

6. The system of claim 1 wherein said second RFID sensor is provided in a predetermined vicinity of said user device.

7. The system of claim 6 wherein said second RFID sensor is an electronic card or key.

8. The system of claim 1 wherein said means for activating comprises:

said first RFID sensor receiving an authentication value associated with the subscription service from said second RFID sensor.

9. The system of claim 8 wherein the authentication value is a hash value on concatenations of tag id and random number.

10. The system of claim 9 wherein the hash value is generated using SHA-1 or SHA-x.

11. The system of claim 1 wherein the subscription service is activated for a predetermined period of time.

12. A method for activation of a user for subscription service comprising the steps of:

associating a first RFID sensor with a subscription-based device, said subscription-based device providing said subscription service;

associating a second RFID sensor with a user device;

activating said user device based on communication between said first RFID sensor and said second RFID sensor, wherein said subscription-based device can broadcast said subscription service to said user device after activation of said user device;

providing a reader; and activating said first RFID sensor when said first RFID sensor is in a predetermined vicinity of said reader.

13. The method of claim 12 further comprising:

a plurality of said subscription-based devices; and a plurality of first RFID sensors, each of said subscription-based devices being associated with one of said first RFID sensors.

14. The method of claim 12 further comprising:

a plurality of user devices and a plurality of second RFID sensors each of said user devices being associated with one of said second RFID sensors.

15. The method of claim 12 wherein said subscription based device is a satellite radio receiver.

16. The method of claim 12 wherein said user device is headphones.

17. The method of claim 12 wherein said second RFID sensor is provided in a predetermined vicinity of said user device.

18. The method of claim 17 wherein said second RFID sensor is an electronic card or key.

19. The method of claim 12 wherein said step of activating said user device comprises communicating an authentication value associated with the subscription service from said second RFID sensor to said first RFID sensor.

20. The method of claim 19 wherein the authentication value is a hash value.

21. The method of claim 20 wherein the hash value is generated using SHA-1 or SHA-x.

22. The method of claim 12 wherein the subscription service is activated for a predetermined period of time.

23. A method for activation of a user for subscription service comprising the steps of:

associating a first RFID sensor with a subscription-based device, said subscription-based device providing said subscription service;

associating a second RFID sensor with a user device;

activating said user device based on communication between said first RFID sensor and said second RFID sensor, said subscription-based device can broadcast said subscription service to said user device after activation of said user device;

activating said subscription service for a predetermined period of time;

activating said user device based on communication between said first RFID sensor and said second RFID sensor, said subscription-based device can broadcast said subscription service to said user device after authentication of said user device;

providing a reader; and activating or deactivating said first RFID sensor when said first RFID sensor is in a predetermined vicinity of said reader.

* * * * *